US012408782B1

(12) United States Patent
Pu

(10) Patent No.: US 12,408,782 B1
(45) Date of Patent: Sep. 9, 2025

(54) SIZE-ADJUSTABLE NET FRAME AND WARDROBE STAND

(71) Applicant: GAATU INC, Tracy, CA (US)

(72) Inventor: Yubin Pu, Tracy, CA (US)

(73) Assignee: GAATU INC, Tracy, CA (US)

( * ) Notice: Subject to any disclaimer, the term of this patent is extended or adjusted under 35 U.S.C. 154(b) by 0 days.

(21) Appl. No.: 18/810,786

(22) Filed: Aug. 21, 2024

(51) Int. Cl.

| | |
|---|---|
| ***A47G 25/06*** | (2006.01) |
| ***A47B 45/00*** | (2006.01) |
| ***A47B 47/00*** | (2006.01) |
| ***A47B 96/02*** | (2006.01) |

(52) U.S. Cl.
CPC ..... *A47G 25/0664* (2013.01); *A47B 45/00* (2013.01); *A47B 47/0008* (2013.01); *A47B 96/025* (2013.01); *A47B 47/005* (2013.01); *A47B 47/0083* (2013.01)

(58) Field of Classification Search
CPC .. A47G 25/0664; A47B 96/025; A47B 45/00; A47B 57/34; A47B 57/32; A47B 57/10; A47B 57/08; A47B 47/0083; A47B 47/005; A47B 47/0008; A47B 47/00; A47B 57/06; A47B 57/545; A47B 47/045
See application file for complete search history.

(56) References Cited

U.S. PATENT DOCUMENTS 573,835 A * 12/1896 Taylor ..... A47G 25/743 211/175
D215,773 S * 10/1969 Maslow ..... D6/675.5
3,760,744 A * 9/1973 Cruckshank ..... A47B 45/00 108/102
3,998,170 A * 12/1976 Gordon ..... A47B 45/00 248/172
4,629,077 A * 12/1986 Niblock ..... A47B 57/265 211/187
D289,479 S * 4/1987 Brancher ..... D6/705.6
D326,579 S * 6/1992 Leeds ..... D6/705.6
D341,967 S * 12/1993 Cohn ..... D6/705.7
5,584,405 A * 12/1996 Tunzi ..... A47B 45/00 D15/89
D413,218 S * 8/1999 Doty ..... D6/675.5
6,142,321 A * 11/2000 West ..... A47B 45/00 211/175
D455,585 S * 4/2002 West ..... D6/705.7
(Continued)

*Primary Examiner* — Devin K Barnett
(74) *Attorney, Agent, or Firm* — Li & Cai Intellectual Property (USA) Office

(57) ABSTRACT

A size-adjustable net frame and a wardrobe stand are provided, including an outer net assembly, an inner net assembly, and a locking assembly. The outer net assembly includes two opposite supporting rails, first supporting rods between the two supporting rails, and a first connecting piece arranged at the same ends of the two supporting rails. The inner net assembly includes two first supporting frames, second supporting rods between the two first supporting frames, a second connecting piece at one ends of the first supporting frames away from the outer net assembly, and a moving assembly at one ends of the two first supporting frames away from the second connecting piece. The inner net assembly is partially retractably arranged within the outer net assembly through the moving assembly and the supporting rails. A locking assembly locks a relative position between the outer net assembly and the inner net assembly.

9 Claims, 4 Drawing Sheets

(56) References Cited

U.S. PATENT DOCUMENTS 6,457,594 B1 * 10/2002 Tiemann ..... A47J 36/22 211/181.1
6,622,876 B2 * 9/2003 Goldberg ..... A47F 5/01 108/147.11
7,246,711 B1 * 7/2007 Metcalf ..... A47B 57/16 211/90.03
7,992,730 B2 * 8/2011 Huang ..... A47B 57/265 211/187
8,256,630 B2 * 9/2012 Zhu ..... A47B 31/04 211/195
D690,966 S * 10/2013 Goodman ..... D6/675.5
8,678,207 B2 * 3/2014 Shimazaki ..... A47B 57/545 211/208
D724,358 S * 3/2015 Tsai ..... D6/675.3
D730,666 S * 6/2015 Goodman ..... D6/675.3
D742,665 S * 11/2015 Goodman ..... D6/675.5
D766,024 S * 9/2016 Brooks ..... D6/705.7
D785,995 S * 5/2017 Tsai ..... D6/705.6
10,077,934 B1 * 9/2018 Dizon ..... F25D 25/005
10,098,460 B1 * 10/2018 Brinton, Jr. ..... A47B 96/145
D936,401 S * 11/2021 Wang ..... D6/675.5
D974,089 S * 1/2023 Sabounjian ..... D6/675.5
D985,317 S * 5/2023 Dart ..... D6/678
11,744,362 B1 * 9/2023 Floarea ..... A47B 45/00 211/90.01
11,930,922 B1 * 3/2024 Levine ..... A47B 45/00
2004/0124165 A1 * 7/2004 Miller ..... A47B 45/00 211/175
2009/0241812 A1 * 10/2009 Liu ..... A47B 57/265 108/147.19
2013/0341296 A1 * 12/2013 Sanford ..... F16B 12/40 211/187
2014/0034591 A1 * 2/2014 Szpak ..... A47F 5/005 211/49.1
2016/0198847 A1 * 7/2016 Fu ..... A47B 47/0083 211/187
2020/0072474 A1 * 3/2020 Nelson ..... F24C 15/16
2020/0297110 A1 * 9/2020 Lim ..... A47F 5/13
2021/0259438 A1 * 8/2021 Oody ..... A47F 5/13
2022/0167791 A1 * 6/2022 Masek ..... A47J 37/0786

* cited by examiner

SIZE-ADJUSTABLE NET FRAME AND WARDROBE STAND

FIELD OF THE DISCLOSURE

The present disclosure relates to a field of wardrobe stand, and more particularly to a size-adjustable net frame and wardrobe stand.

BACKGROUND OF THE DISCLOSURE

The simple wardrobe is a convenient and practical storage furniture for storing clothes, shoes, hats, etc. The simple wardrobe usually includes a wardrobe stand and a fabric cover that is placed outside the wardrobe stand, and is especially suitable for a limited space. The wardrobe stand usually includes four supporting upright rods with a net frame fixed on them. The net frame is usually used to support the clothes or to hang clothes hangers.

Most of the conventional net frames are made of a metal frame fixed by welding metal wires. The net frames generally take on a regular size in terms of length and width. Therefore, they cannot be contracted or stretched in accordance with the size desired by consumers, and their adaptability to the environment is limited. In addition, the net frames of a regular size tend to occupy excessive space during transportation and require more materials for packaging, resulting in higher costs.

Consequently, it becomes necessary to design a size-adjustable net frame and a wardrobe stand which are friendlier to consumers and sellers alike with their superior adaptation to a wide range of scenarios.

SUMMARY OF THE DISCLOSURE

The purpose of the present disclosure is to provide a size-adjustable net frame and a wardrobe stand, which at least solves one of the above technical problems arising from existing technical defects and inadequacies. The size-adjustable net frame and the wardrobe stand have the advantage of bringing convenience to consumers or sellers by adjusting the size and adapting to a wide range of scenarios.

In order to solve the above-mentioned problems, one of the technical aspects adopted by the present disclosure is to provide a size-adjustable net frame, which includes:

an outer net assembly including two supporting rails which are arranged opposite to each other, a plurality of first supporting rods arranged between the two supporting rails, and a first connecting piece arranged at the same ends of the two supporting rails;

an inner net assembly including two first supporting frames which are arranged opposite to each other, a plurality of second supporting rods arranged between the two first supporting frames, a second connecting piece correspondingly arranged at one end of each of the two first supporting frames that is away from the outer net assembly, and a moving assembly correspondingly arranged at one end of each of the two first supporting frames that is away from the second connecting piece;

wherein a part of the inner net assembly retractably arranged within the outer net assembly through the moving assembly and the supporting rails, and the size-adjustable net frame further includes a locking assembly for locking a relative position between the outer net assembly and the inner net assembly.

Preferably, the supporting rail is a C-shaped rail with an opening facing inward, and the moving assembly is a pulley rotatably arranged on the first supporting frames.

Preferably, a side plate of the supporting rail has a triangular hollow grooves staggered along a length direction of the supporting rail.

Preferably, a fixing plate is arranged inside the first supporting frames, the fixing plate has a rotating shaft extending toward the first supporting frame, and the pulley is rotatably connected to the rotating shaft, so as to be rotationally arranged on the first support frame.

Preferably, the size-adjustable net frame further includes a caulking, the caulking is inserted into a free end of the supporting rail that is away from the first connecting piece, so as to prevent the pulley from sliding beyond the supporting rail.

Preferably, the supporting rail is designed with a through hole at an end away from the first connecting piece; the locking assembly includes a L-shaped locking piece with a screw hole and a screw fastener; during assembly, the L-shaped locking piece is arranged on a side of the first supporting frame (21) away from the supporting rail, the screw fastener passes through the through hole from an outside of the supporting rail, and the first supporting frame is threadedly assembled with the screw hole.

Preferably, a second supporting frame is arranged between the two first connecting pieces, a third supporting frame is arranged between the same ends of the first supporting frames, each of the first supporting frame, the second supporting frame, and the third supporting frame includes a top rod, a bottom rod, and a connecting curved rod that is in a shape of a triangular wavy line arranged between the top rod and the bottom rod, a wave crest and a wave trough of the connecting curved rod are respectively connected to the top rod and the bottom rod.

Preferably, the plurality of first supporting rods are a plurality of metal wires welded correspondingly on an upper side of the supporting rails and the second supporting frame in a crisscross pattern; the plurality of second supporting rods are a plurality of metal wires welded correspondingly on the first supporting frames and the third supporting frame in a crisscross pattern.

Preferably, each of the first connecting pieces and the second connecting pieces is a connecting sleeve with a tapered through hole having an upper aperture smaller than a lower aperture.

Another technical aspect adopted by the present disclosure is to provide a wardrobe stand including four supporting upright rods and the size-adjustable net frame mentioned above. The size-adjustable net frame is assembled to the supporting poles through the first connecting pieces and the second connecting pieces.

Compared with the prior art, the beneficial effects of the present application are:

Because a part of the inner net assembly of the size-adjustable net frame can be retractably arranged within the outer net assembly through the moving assembly at one end of the two first supporting frame and the two supporting rails of the outer net assembly, and then locking is conducted by the locking assembly after adjusting to a suitable size. Therefore, a length or a width of the size-adjustable net frame may be adjusted, so that consumers or sellers may adjust to an appropriate size according to the living space or packaging space, thereby avoiding repeated purchases or reducing packaging space, so as to reduce costs and adapt to a wide range of scenarios.

BRIEF DESCRIPTION OF THE DRAWINGS

In order to shed more light on the embodiments of the present disclosure or the technical solutions in the prior art, the drawings to be used in the embodiments or the description of the prior art will be briefly described below. Obviously, the drawings in the following description are only a certain embodiment of the present disclosure, and other drawings can be obtained by those skilled in the art without any inventive effort.

Figure 1:
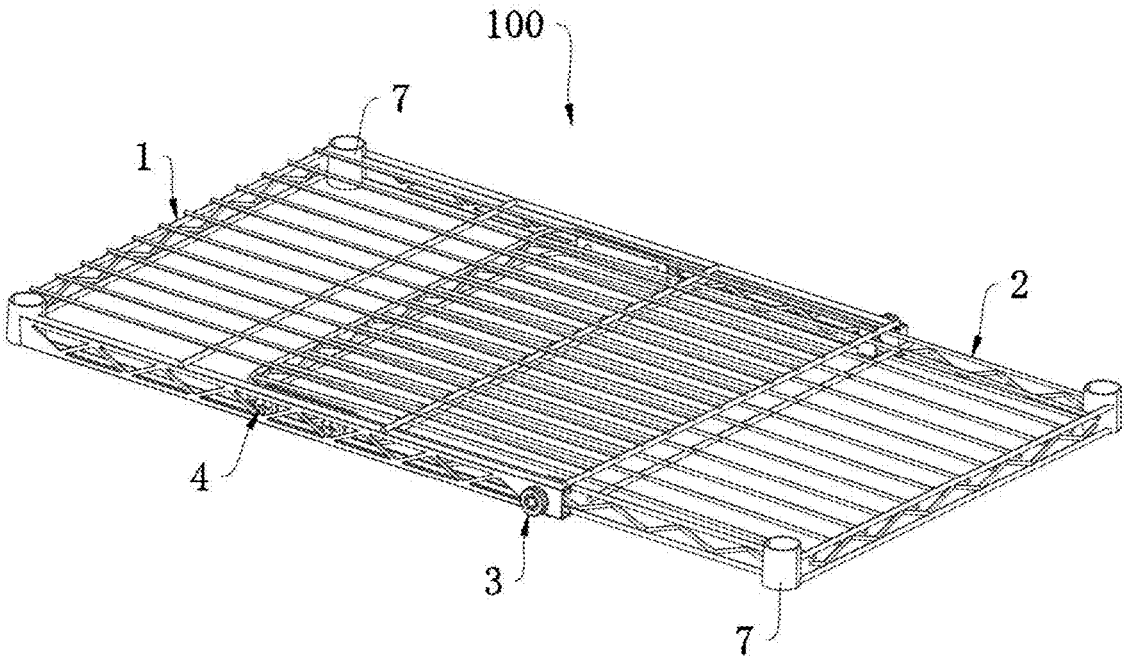
FIG. 1 is a schematic structural view of an outer net assembly and an inner net assembly that are assembled and locked according to an embodiment of the present disclosure.

Reference numerals: 100, size-adjustable net frame; 1, outer net assembly; 11, supporting rail; 111, side plate; a, 12, first supporting rod; 13, second supporting frame; 131, top rod; 132, bottom rod; 133, connecting curved rod; 2, inner net assembly; 21, first supporting frame; 22, second supporting rod; 23, third supporting frame; 3, locking assembly; locking assembly; 31, c, 32, 4, 5, fixing plate; 51, rotating shaft; 6, caulking; 7, connecting sleeve.

DETAILED DESCRIPTION OF THE EXEMPLARY EMBODIMENTS

The technical solutions of the present disclosure will be clearly and completely described below with reference to the accompanying drawings, and it is apparent that the described embodiments are some, but not all embodiments of the present disclosure. All other embodiments, which can be derived by a person skilled in the art from the embodiments given herein without making any creative effort, shall fall within the protection scope of the present disclosure.

It should be noted that the terms "longitudinal", "transverse", "up", "down", "front", "back", "left", "right", "top", "bottom", "inside", "outside", "back", "side", "circumferential", and the like of the present disclosure indicate orientations or positional relationships based on the orientations or positional relationships shown in the drawings, and are merely for convenience in describing the present disclosure and simplifying the description, and do not indicate or imply that the apparatus or elements referred to must have a specific orientation, be configured and operated in a specific orientation, and therefore should not be construed as limiting the present disclosure. Moreover, the terms first, second, etc. are only used to distinguish a plurality of components or structures having the same or similar structure, and do not denote any particular limitation on the arrangement order or connection relationship.

Referring to FIG. 1 to FIG. 9, the present disclosure provides a size-adjustable net frame 100 which can be used to manufacture wardrobe racks (not show in the figures). The size-adjustable net frame 100 includes an outer net assembly 1, an inner net assembly 2, and a locking assembly 3. The outer net assembly 1 includes two supporting rails 11, a plurality of first supporting rods 12, and two first connecting pieces. The two supporting rails 11 are arranged opposite to each other, and can be made of steel or alloy with a certain support strength and torsional strength. The plurality of first supporting rods 12 are correspondingly arranged between the two supporting rails 11 to form a net structure for supporting and storing clothes or hanging clothes hangers after the wardrobe is formed. The first connecting pieces are correspondingly arranged at the same end of the two supporting rails 11, so as to assemble the outer net assembly 1 to supporting poles (not shown in the figures). The inner net assembly 2 includes two first supporting frames 21, a plurality of second supporting rods 22, and two second connecting pieces. The two first supporting frames 21 are arranged opposite to each other, and can be made of steel or alloy with a certain support strength and torsional strength. The plurality of second supporting rods 22 are correspondingly arranged between the two first supporting frames 21 to form a net structure for supporting and storing clothes or hanging clothes hangers after the wardrobe is formed. The second connecting pieces are correspondingly arranged at one end of each of the two first supporting frames 21 that is away from the outer net assembly 1. The moving assembly is correspondingly arranged at one end of each of the two first supporting frames 21 that is away from the second connecting piece. A part of the inner net assembly 2 can be retractably arranged within the outer net assembly 1 through the moving assembly and the supporting rails 11. Specifically, the clearance between the two supporting rails 11 of the outer net assembly 1 is greater than that between the two first supporting frames 21 of the inner net assembly 2, so that the part of the inner net assembly 2 can be retractably arranged within the outer net assembly 1 without interference. The locking assembly 3 is used to lock a relative position between the outer net assembly 1 and the inner net assembly 2, so as to lock a size of the size-adjustable net frame 100. Specifically, in the present embodiment, the two supporting rails 11 and the two first supporting frames 21 can serve as a long side of the size-adjustable net frame 100, so that the length of the size-adjustable net frame 100 can be adjusted. Of course, in other embodiments, the two supporting rails 11 and the two first supporting frames 21 can serve as a short side of the size-adjustable net frame 100, so that the width of the size-adjustable net frame 100 can be adjusted, but the specific implementations are not limited herein.

A part of the inner net assembly 2 of the size-adjustable net frame 100 can be retractably arranged within the outer net assembly 1 through the moving assembly at one end of the two first supporting frame 21 and the two supporting rails 11 of the outer net assembly 1, and then locking is conducted by the locking assembly 3 after adjusting to a suitable size. Therefore, the length or width of the size-adjustable net frame 100 can be adjusted, so that consumers or sellers can adjust the size-adjustable net frame 100 to an appropriate size according to the living space or packaging space, thereby avoiding repeated purchases or reducing packaging space, so as to reduce costs and adapt to a wide range of scenarios.

Preferably, referring to FIG. 2 to FIG. 5 and FIG. 7, in the present embodiment, the supporting rail 11 is a C-shaped rail with an opening facing inward. That is, a cross section of the supporting rail 11 is substantially C-shaped, and the opening facing inward means that directions of the openings of the two supporting rails 11 are opposite to each other. The moving assembly includes pulleys 4 rotatably arranged on the first supporting frames 21. In this way, when the inner net assembly 2 retractably moves relative to the outer net assembly 1, the pulleys 4 can move in a chute of the supporting rail 11, and the C-shaped opening of the supporting rail 11 avoids the rotating shaft 51 of the pulley 4. Therefore, the expansion of the inner net assembly 2 relative to the outer net assembly 1 is smoother. In addition, the C-shaped track structure also has the advantages of robustness and stability.

Figure 5:
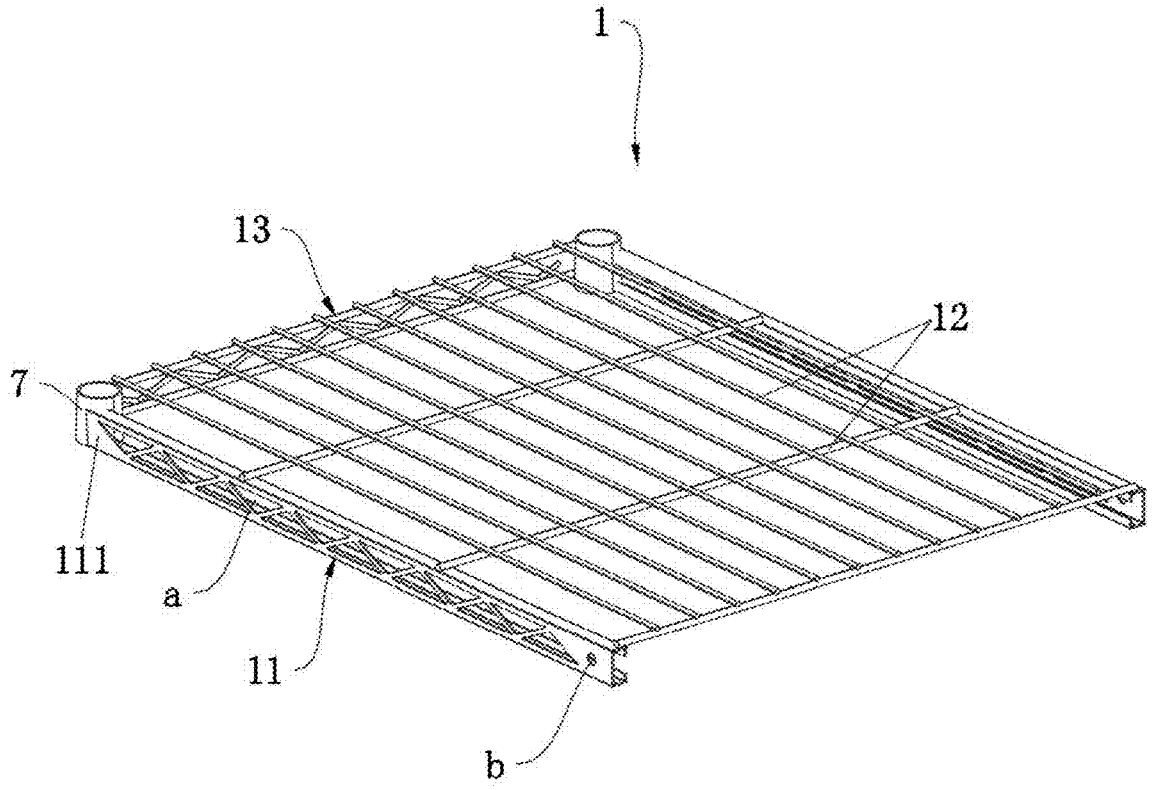
FIG. 5 is a schematic structural view of the outer net assembly according to the embodiment of the present disclosure.

In order to reduce a counterweight of the outer net assembly 1 without reducing a load-bearing capacity and torsional strength of the supporting rails 11, preferably, in the present embodiment, a side plate 111 of the supporting rail 11 has a triangular hollow groove a staggered along a length direction of the supporting rail 11 (FIG. 5).

Figure 2:
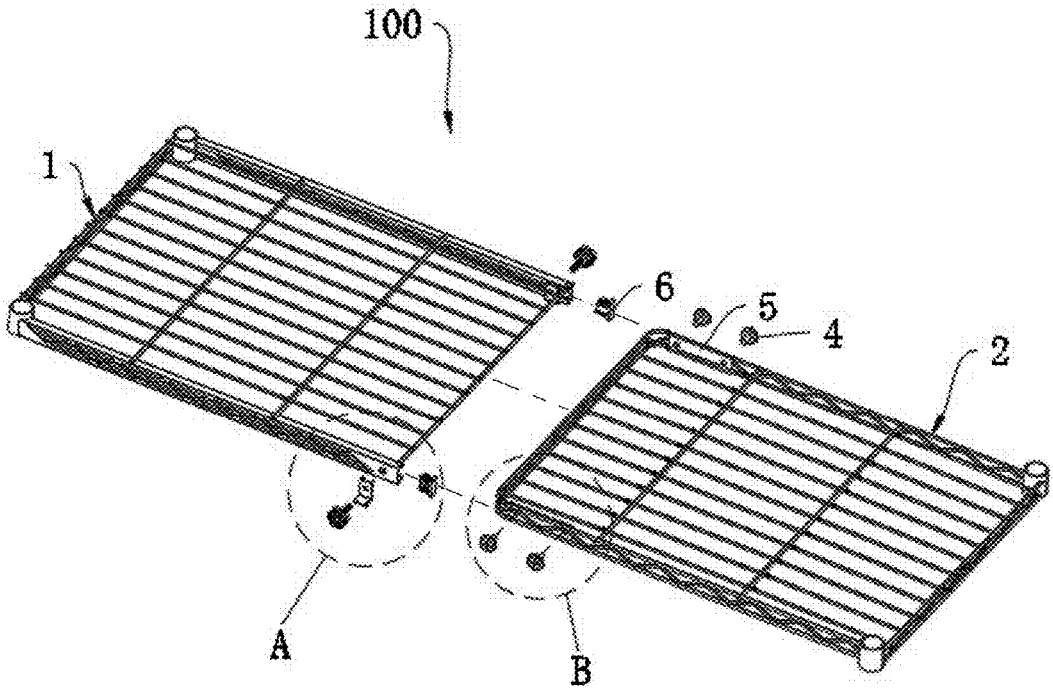
FIG. 2 is a schematic exploded view of a partial structure according to the embodiment of the present disclosure.
Figure 4:
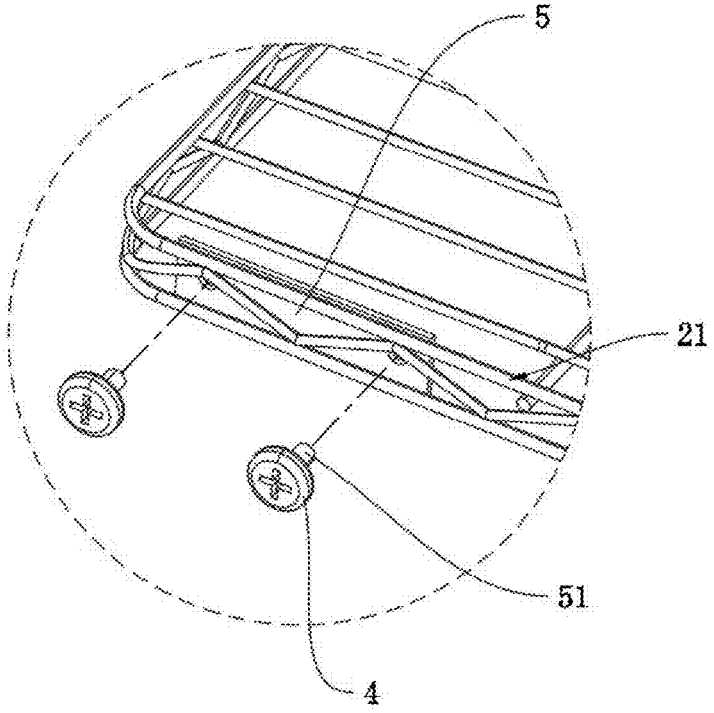
FIG. 4 is a partial enlarged view of part B of FIG. 2.
Figure 8:
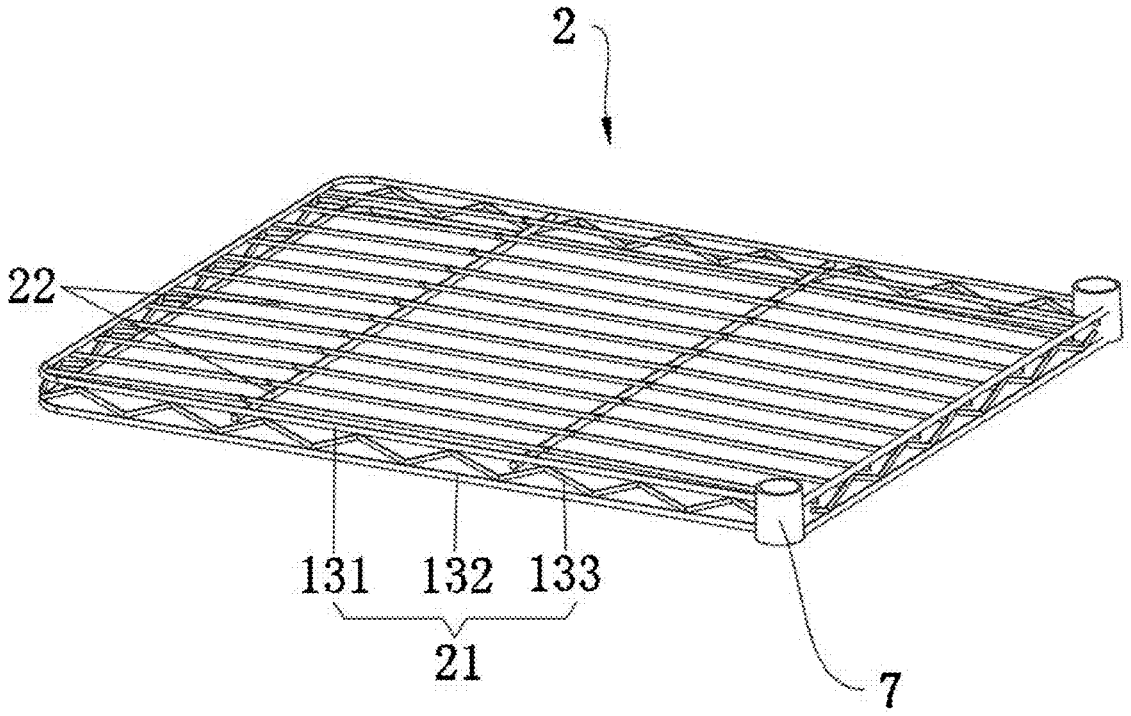
FIG. 8 is a schematic structural view of the inner net assembly of a perspective according to the embodiment of the present disclosure.

Preferably, referring to FIG. 2, FIG. 4, and FIG. 8, in the present embodiment, a fixing plate 5 is arranged inside the first supporting frame 21. The fixing plate 5 has a rotating shaft 51 extending toward the first supporting frame 21, the pulley 4 is rotatably connected to the rotating shaft 51 so as to be arranged on the first supporting frame 21. Specifically, the fixing plate 5 is welded inside the first supporting frame 21, the rotating shaft 51 on the fixing plate 5 passes through the first supporting frames 21, and the pulley 4 is rotatably arranged on the rotating shaft 51 and is located outside the first supporting frame 21.

Figure 3:
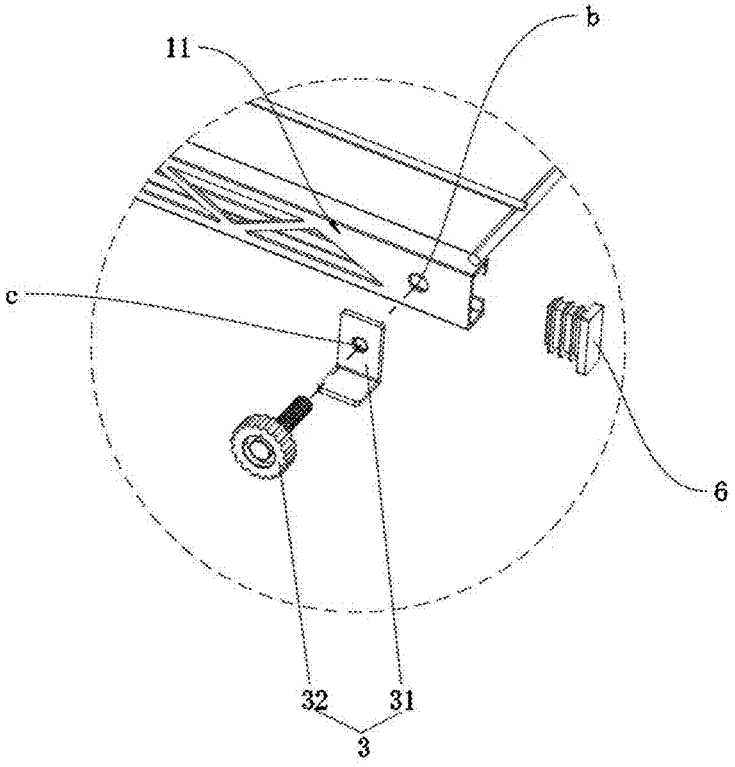
FIG. 3 is a partial enlarged view of part A of FIG. 2.

To prevent the pulley 4 from sliding out from the free end of the supporting rails 11 when adjusting the size through the outer net assembly 1 and the inner net assembly 2, preferably, in the present embodiment, the size-adjustable net frame 100 further includes caulking 6 (FIG. 2 and FIG. 3). The caulking 6 is inserted into a free end of the supporting rail 11 that is away from the first connecting piece, so as to prevent the pulley 4 from sliding beyond the supporting rail 11.

Referring to FIG. 2 and FIG. 3, to facilitate locking the relative position between outer net assembly 1 and the inner net assembly 2, preferably, in the present embodiment, the supporting rail 11 has a through hole b at an end away from the first connecting piece. The locking assembly 3 includes L-shaped locking pieces 31 each with a screw hole c and a screw fastener 32, and the L-shaped locking piece 31 is arranged on a side of the first supporting frame 21 away from the supporting rail 11 during assembly. Specifically, a vertical plate of the L-shaped locking piece 31 is arranged on the side of the first supporting frame 21 away from the supporting rail 11, a horizontal plate of the L-shaped locking piece 31 is correspondingly abutted against the supporting rail 11 and a lower end of the first supporting frames 21. The screw fastener 32 passes through the through hole b from outside of the supporting rail 11, and the first supporting frame 21 is threadedly assembled with the screw hole c, so as to press the supporting rails 11 and the first supporting frames 21 between the L-shaped locking piece 31 and the screw fastener 32.

Figure 6:
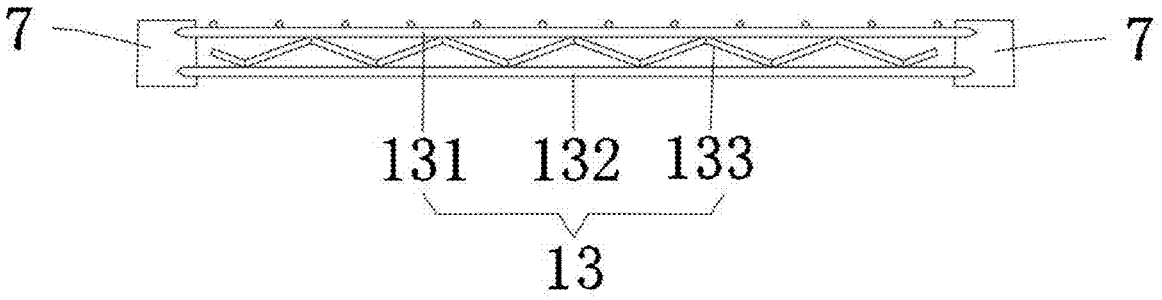
FIG. 6 is a schematic left side view of the outer net assembly according to the embodiment of the present disclosure.
Figure 7:
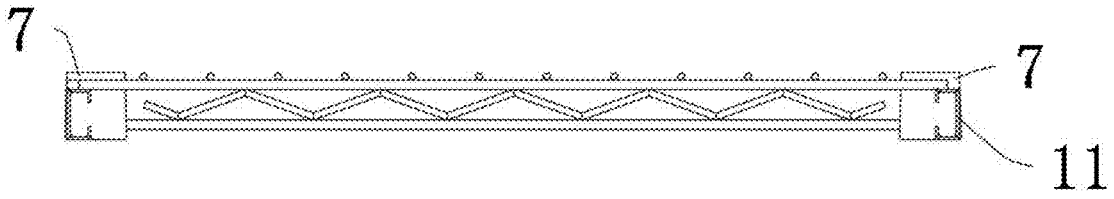
FIG. 7 is a schematic right side view of the outer net assembly according to the embodiment of the present disclosure.
Figure 9:
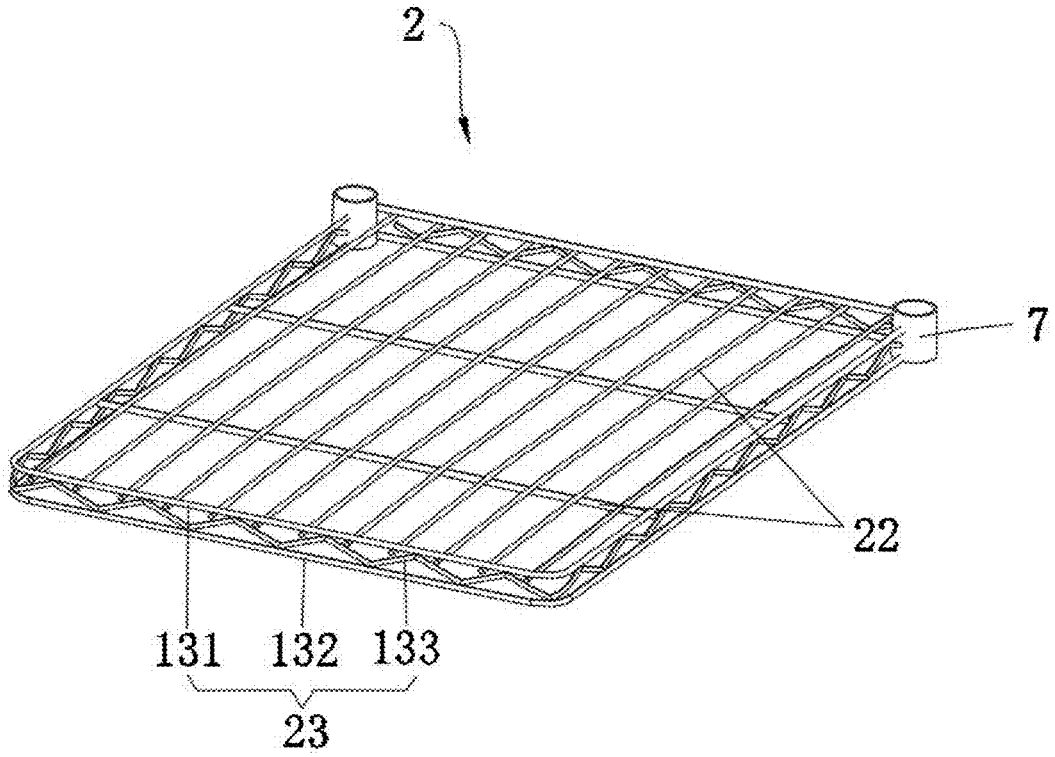
FIG. 9 is a schematic structural view of the inner net assembly of another perspective according to the embodiment of the present disclosure.

Referring to FIG. 6, FIG. 8 and FIG. 9, to increase the supporting strength of the outer net assembly 1 and the inner net assembly 2, preferably, in the present embodiment, a second supporting frame 13 is arranged between the two first connecting pieces, a third supporting frame 23 is arranged between the same ends of the first supporting frames 21. Preferably, each of the first supporting frame 21, the second supporting frame 13, and the third supporting frame 23 includes a top rod 131, a bottom rod 132, and a connecting curved rod 133 that is in a shape of a triangular wavy line arranged between the top rod 131 and the bottom rod 132, and a wave crest and a wave trough of the connecting curved rod 133 are respectively connected to the top rod 131 and the bottom rod 132. Specifically, the top rod 131 and the bottom rod 132 can be made from steel or alloy rods. The curved rod may be steel or alloy wire, which is welded between the top rod 131 and the bottom rod 132 by bending.

Referring to FIG. 1, preferably, in the present embodiment, each of the first connecting piece and the second connecting piece is a connecting sleeve 7, and the connecting sleeve 7 has a tapered through hole b having an upper aperture smaller than a lower aperture. In this way, the size-adjustable net frame 100 can be sleeved on a support rod with a tapered outer circumference (not show in the figures) through four connecting sleeves 7. Of course, in other embodiments, each of the first connecting pieces and the second connecting pieces can be an angle plate (not show in the figures), which are fixed to the support rod by screws, but the present is not limited thereto.

Referring to FIG. 5 and FIG. 8, preferably, in the present embodiment, the first supporting rods 12 are a plurality of metal wires welded correspondingly on the upper side of the supporting rails 11 and the second supporting frame 13 in a crisscross pattern. The second supporting rods 22 are a plurality of metal wires welded correspondingly on the first supporting frames 21 and the third supporting frame 23 in a crisscross pattern. Specifically, the metal wires can be iron ones. In this way, a higher supporting strength can be achieved.

Another aspect of the present disclosure provides a wardrobe stand (not show in the figures), which includes four supporting upright rods and the size-adjustable net frame 100 mentioned above. The size-adjustable net frame 100 is assembled to the supporting poles through the first connecting pieces and the second connecting pieces. Because the wardrobe stand has all the structure and connection relationships of the size-adjustable net frame 100, therefore, the wardrobe stand has all the advantages of the size-adjustable net frame 100, which will not be described in detail again.

Finally, it should be noted that: the above embodiments are only for illustrating the technical solution of the present application, and not for limiting the same; although the application has been described in detail with reference to the foregoing embodiments, it will be understood by those of ordinary skill in the art that: the technical scheme described in the foregoing embodiments can be modified or some or all of the technical features thereof can be replaced by equivalents; such modifications and substitutions do not depart from the spirit of the corresponding technical solutions.

What is claimed is:

1. A size-adjustable net frame, comprising:

an outer net assembly (1), including two supporting rails (11) which are arranged opposite to each other, a plurality of first supporting rods (12) arranged between the two supporting rails (11), and a first connecting piece correspondingly arranged at one end of each of the two supporting rails (11) that corresponds to each other;

an inner net assembly (2), including two first supporting frames (21) which are arranged opposite to each other, a plurality of second supporting rods (22) arranged between the two first supporting frames (21), a second connecting piece correspondingly arranged at one end of each of the two first supporting frames (21) that is away from the outer net assembly (1), and a moving assembly correspondingly arranged at one end of each of the two first supporting frames (21) that is away from the second connecting piece;

wherein a part of the inner net assembly (2) retractably arranged within the outer net assembly (1) through the moving assembly and the supporting rails (11), and the size-adjustable net frame further comprises a locking assembly (3) for locking a relative position between the outer net assembly (1) and the inner net assembly (2);

wherein the supporting rail (11) is a C-shaped rail with an opening facing inward, and the moving assembly is a pulley (4) rotatably arranged on the first supporting frames (21).

2. The size-adjustable net frame according to claim 1, wherein a side plate (111) of the supporting rail (11) has triangular hollow grooves (a) staggered along a length direction of the supporting rail (11).

3. The size-adjustable net frame according to claim 1, wherein a fixing plate (5) is arranged inside the first supporting frame (21), the fixing plate (5) has a rotating shaft (51) extending toward the first supporting frame (21), and the pulley (4) is rotatably connected to the rotating shaft (51).

4. The size-adjustable net frame according to claim 1, further comprising a caulking (6), wherein the caulking (6) is inserted into a free end of the supporting rail (11) that is away from the first connecting piece, so as to restrict the pulley (4) from sliding out of the supporting rail (11).

5. The size-adjustable net frame according to claim 1, wherein the supporting rail (11) has a through hole (b) at an end away from the first connecting piece; the locking assembly (3) includes a L-shaped locking piece (31) with a screw hole (c) and a screw fastener (32); wherein, during assembly, the L-shaped locking piece (31) is arranged on a side of the first supporting frame (21) away from the supporting rail (11), the screw fastener (32) passes through the through hole (b) from an outside of the supporting rail (11), and the first supporting frame (21) is threadedly assembled with the screw hole (c).

6. The size-adjustable net frame according to claim 1, wherein a second supporting frame (13) is arranged between the two first connecting pieces, a third supporting frame (23) is arranged between the same ends of the first supporting frames (21), each of the first supporting frame (21), the second supporting frame (13), and the third supporting frame (23) includes a top rod (131), a bottom rod (132), and a connecting curved rod (133) that is in a shape of a triangular wavy line arranged between the top rod (131) and the bottom rod (132), wherein a wave crest and a wave trough of the connecting curved rod (133) are respectively connected to the top rod (131) and the bottom rod (132).

7. The size-adjustable net frame according to claim 6, wherein the plurality first supporting rods (12) are a plurality of metal wires welded correspondingly on an upper side of the supporting rails (11) and the second supporting frame (13) in a crisscross pattern; the plurality of second supporting rods (22) are a plurality of metal wires welded correspondingly on the first supporting frames (21) and the third supporting frame (23) in a crisscross pattern.

8. The size-adjustable net frame according to claim 1, wherein each of the first connecting pieces and the second connecting pieces are a connecting sleeve (7) with a tapered through hole (b) having an upper aperture smaller than a lower aperture.

9. A wardrobe stand, comprising four supporting upright rods and the size-adjustable net frame as claimed in claim 1, wherein the size-adjustable net frame is assembled to the supporting poles through the first connecting pieces and the second connecting pieces.

* * * * *